United States Patent [19]

Rocchetti

[11] 4,444,278

[45] * Apr. 24, 1984

[54] ROTATABLE DRILLING HEAD

[76] Inventor: Frankie Rocchetti, P.O. Box 195, Crumpler, W. Va. 24825

[ * ] Notice: The portion of the term of this patent subsequent to Sep. 6, 2000 has been disclaimed.

[21] Appl. No.: 410,816

[22] Filed: Aug. 23, 1982

Related U.S. Application Data

[63] Continuation-in-part of Ser. No. 371,984, Apr. 26, 1982, Pat. No. 4,402,371.

[51] Int. Cl.[3] ..... E21B 10/44

[52] U.S. Cl. ..... 175/108; 175/172; 175/394; 299/56

[58] Field of Search ..... 299/18, 56, 87, 90; 175/108, 172, 173, 392, 393, 394

[56] References Cited

U.S. PATENT DOCUMENTS

| | | | |
|---|---|---|---|
| 161,865 | 4/1875 | Cook . | |
| 1,485,455 | 3/1924 | Freda | 175/172 |
| 1,996,347 | 4/1935 | Reppert . | |
| 2,562,841 | 7/1951 | Compton . | |
| 2,770,449 | 11/1956 | McCarthy . | |
| 2,810,566 | 10/1957 | Parsons | 299/87 |
| 2,841,379 | 7/1958 | Driehaus | 299/90 |
| 2,946,567 | 7/1960 | Pepper | 299/56 |
| 3,094,397 | 6/1963 | Lopker . | |
| 3,642,325 | 2/1972 | Mulvaney | 299/56 |
| 4,219,239 | 8/1980 | Weikert et al. | 299/90 |
| 4,275,926 | 6/1981 | Hodges | 299/87 |

*Primary Examiner*—Stephen J. Novosad
*Assistant Examiner*—William P. Neuder
*Attorney, Agent, or Firm*—Cushman, Darby & Cushman

[57] ABSTRACT

A drilling head for use in mining operations comprises a cylindrical drum having an open rear end and defining an interior cavity, an exterior spiral arranged to forwardly advance mined particles, a nose spiral disposed in advance of the drum and arranged so as to rearwardly advance the mined particles, the exterior and nose spirals terminating generally at the front portion of the drum and together defining at least one recovery aperture through which the mined particles forwardly advanced by the exterior spiral and rearwardly advanced by the nose spiral can pass to the interior cavity, and an interior spiral coaxially disposed and rotatable in the interior cavity in a direction opposing the rotational direction of the drum.

8 Claims, 4 Drawing Figures

ROTATABLE DRILLING HEAD

RELATED APPLICATIONS

This application is a continuation-in-part of my copending U.S. Pat. application Ser. No. 371,984, filed Apr. 26, 1982, now U.S. Pat. No. 4,402,371 issued Sept. 6, 1983.

BACKGROUND AND SUMMARY OF THE INVENTION

The present invention relates to a rotatable drilling head normally utilized in underground mining operations for cutting particles of a material, for example, coal, from a seam of such material so as to remove it from the mine. The rotatable drilling head according to the present invention provides a cylindrical drum having a front end and an open rear end and defines an interior cavity. On the exterior circumferential surface of the drum, a first spiral is outwardly projected which is disposed in a manner to forwardly advance coal particles between adjacent convolutions thereof. In advance of the drum there is provided a cutting bit for cutting into the coal seam.

Between the cutting bit and the front end of the drum, there is provided a nose spiral which gradually tapers having its successive convolutions increasing in radial dimension as the nose spiral extends between the cutting bit and the front end of the drum. The nose spiral is arranged so that coal particles can be rearwardly advanced thereby. Rigidly carried on the interior of the drum according to one embodiment of the present invention is an interior spiral which extends substantially the entire length of the drum. The direction of the convolutions of the interior spiral is such that the coal particles are rearwardly advanced through the interior of the drum. According to another embodiment of the present invention, the interior spirals are rotatable in a direction opposite to the exterior spirals of the drum.

The nose spiral and the exterior spiral terminate with each other and together define at least one recovery aperture through which the mined coal particles forwardly advancing by virtue of the exterior spiral and rearwardly advancing by virtue of the nose spiral can pass therethrough to the interior cavity of the drum.

Conventional rotatable drilling heads are provided with a spiral which is arranged in a direction so that the mined particles can only be directed rearwardly relative to the direction of advance of the drilling head into a seam of coal. It has been proposed, however, to provide a drum partially surrounding the single direction spiral as evidenced by U.S. Pat. Nos. 2,562,841 to Compton and 2,770,449 to McCarthy. These two prior art references also disclose that an exterior spiral arranged upon the partial drum assembly can be utilized to similarly rearwardly advance the coal. Thus, the prior art drilling heads only contemplate that dual spirals can be provided so that the interior and exterior direction of movement of coal particles is towards the rear of the drilling head.

According to the present invention there is provided a novel rotatable drilling head which generally utilizes three distinct spiral arrangements for drilling and removing coal particles from a seam of coal. The first spiral is arranged on the exterior circumferential surface of a drum while the second spiral is arranged on the interior surface of the drum. Each spiral preferably extends the entire length of the drum. The exterior spiral is arranged in such a manner that rotational movement of the drum encourages coal particles to be forwardly advanced while the interior spiral is arranged so as to encourage the coal particles to be rearwardly advanced. At the front end of the drum, there is provided an additional spiral called herein the nose spiral. The nose spiral gradually tapers so that its largest dimension is adjacent the front end of the drum while the smallest dimension occurs at the cutting bit. The direction of the convolutions of the nose spiral are such that the mined coal particles are encouraged to move rearwardly.

At the front end portion of the drum, the exterior spiral and the nose spiral intercept one another and together define at least one recovery aperture through which the mined coal particles which are being forwardly advanced by virtue of the exterior spiral and rearwardly advanced by virtue of the nose spiral can pass therethrough and be accepted into the interior cavity of the drum. Once the coal particles have passed through the recovery aperture, they are encouraged to rearwardly advance in the interior of the drum by virtue of the interior spirals. The open rear end of the drum permits the coal particles to be removed from the mine by any conventional means such as, for example, conveyors, or the like.

According to another aspect of the present invention a flexible spiral can be provided intermediate adjacent convolutions of the exterior spiral. The flexible spiral is preferably composed of a durable, yet flexible, synthetic rubber-like material and projects from the exterior surface of the drum to the walls of the mined area. Thus, as the drum rotates, the intermediate spiral will flex against the surface of the mine walls so as to "sweep" fine coal particles therefrom in order to maximize coal recovery. The intermediate spirals can be continuously arranged on the exterior surface of the drum or, alternately, could be periodically placed therealong in a spiral arrangement. If the later arrangement is chosen, it is preferable to utilize flexible, yet durable bristles such as metal or synthetic fiber bristles.

Preferably, the rotating drum is supported about a hollow shaft through which a liquid, preferably water, may be injected under pressure. The water travels through the hollow shaft and exits at the central portion of the cutting bit so as to aide the cutting bit in its removal of coal particles. The spent water which has been injected through the shaft may then be picked up by the recovery apertures. This is especially true if a flexible intermediate spiral is used so that a sealing effect is maintained with the walls of the mine. Thus, even though water may be injected into the mine shaft, the extent of water flow therein can be controlled by utilizing the present invention. As such, the present invention acts somewhat like a "pump" to transfer the water injected towards the front of the drilling head and encourage it to move in the interior portion thereof towards the rear where it can then be transferred to any suitable location. Additionally, the use of water greatly facilitates the removal of coal from the mine since a slurry mixture of coal particles and water will be effected. Thus, such slurry mixture may be removed from the mined area utilizing the present invention.

A fan turnable by the rotational movement of the shaft may be provided to effect air flow in a rearward direction. In such a manner, the fan can be provided to entrain fine particles of dust, for example, coal dust, and thereby maintain the quality of atmosphere in a mine shaft according to applicable standards. The rotating drilling head according to the present invention can be adapted to be utilized by any conventional power driven means.

Thus, it is primary object according to the present invention to provide a rotatable drilling head which can be advantageously utilized with conventional power driven means and which can be used to increase the recovery of coal, for example, mined underground. It is also an object of the present invention to provide a rotatable drilling head which is capable of decreasing toxic dust and/or particles which may exist by virtue of mining operations.

These and other objects of the present invention will become more apparent to one in the art after thorough consideration is given to the detailed description of the invention which follows.

BRIEF DESCRIPTION OF THE ACCOMPANYING DRAWINGS

DETAILED DESCRIPTION OF THE PREFERRED EXEMPLARY EMBODIMENTS

Figure 1:
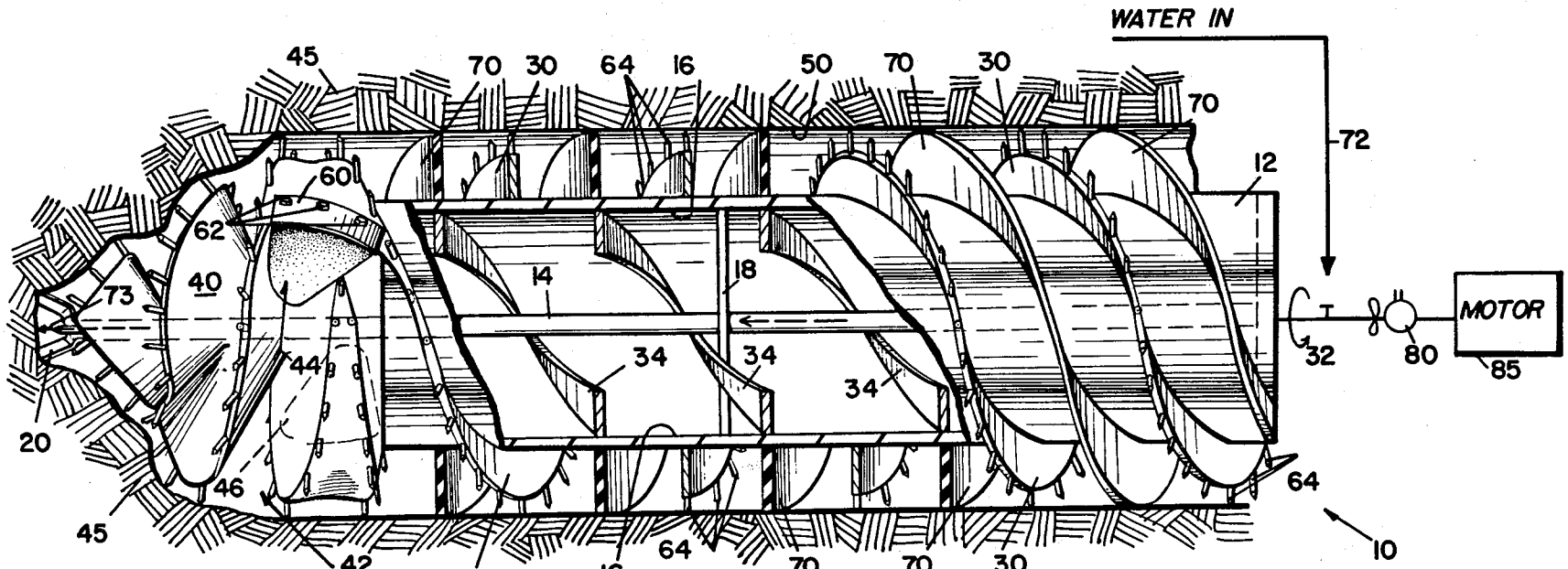
FIG. 1 is a side view partly in section of one preferred exemplary embodiment of a rotatable drilling head according to the present invention.

A preferred exemplary embodiment of the rotatable drilling head 10 according to the present invention is depicted in FIG. 1. The drilling head 10 generally comprises a drum 12 supported by and rotatable in a predetermined direction about a shaft 14. The drum 12 preferably defines a cylindrical interior cavity 16 across which suitable rigid support members 18 extend so as to rigidly connect the drum 12 to the shaft 14 without interrupting the path of coal particles advancing rearwardly in cavity 16 as will be described in more detail below.

At the extreme front portion of the drilling head, there is provided a cutting bit 20 of conventional design and which in and of itself is well known in the art. The cutting bit 20 is axially disposed relative to shaft 14 so as to be concurrently rotated thereby.

On the exterior circumferential surface of the drum there is provided an exterior spiral 30 whose convolutions are arranged so as to encourage coal particles to be forwardly advanced by the rotation of the drum 12 (noted by arrow 32). The interior cavity 16 of drum 12 is provided with interior spirals 34 which are arranged opposite to the exterior spirals 30 so that coal particles can be encouraged to rearwardly advance through the interior cavity 16.

A nose spiral 40 is provided between the cutting bit 20 and the front portion 42 of drum 12. The nose spiral 40 is preferably tapered so that the largest radial dimension of successive convolutions thereof increases as they spirally extend around shaft 14 between the cutting bit 20 and the front portion 42 of the drum 12. An important aspect according to this present invention is the manner in which the nose spiral 40 and the exterior spiral 30 intercept one another.

As can be seen in FIG. 1, the intersection of nose spiral 40 and exterior spiral 30 generally occurs at the front portion 42 of drum 12. Since the nose spiral and the exterior spiral are opposite hand relative to another, they will define recovery apertures 44, 46 in communication with interior cavity 16 of drum 12. As shown in FIG. 1, two recovery apertures 44, 46 are provided, each being in communication with the interior cavity 16 of the drum 12. Thus, as coal particles are cut from the coal seam (noted generally at 45) by virtue of the cutting bit 20, such cut coal particles are rearwardly advanced by virtue of the arrangement of the nose spiral 40 while residual coal particles which may still exist in the mine shaft 50 are forwardly advanced by virtue of the exterior spirals 30. Thus, when such coal particles arrive at the intersection of the nose and exterior spirals 40, 30, they will pass through the recovery apertures 44, 46 and thereby be transferred to the interior cavity 16 of the drum 12. Once such coal particles pass through the recovery apertures 44, 46 and are accepted in the interior cavity of the drum 12, the rotation thereof (arrow 32) will cause them to be rearwardly advanced by virtue of the interior spirals 34.

The size of the coal particles which pass through the recovery apertures 44, 46 may be determined by providing an adjustable cover plate 60 which covers a portion of each recovery apertures 44, 46. Suitable connection means can be utilized such as, bolts 62 cooperating with elongated apertures (not shown) in the drum 12, so that adjustable movement of the cover plate 60 can be effected. In such a manner, the size of the coal particles which pass through the recovery apertures 44, 46 can be predetermined. It should also be appreciated that if a coal particle larger than the size of the recovery aperture attempts to pass therethrough, the cover plate 60 will prevent such action but will also, upon rotational movement of the drum, forceably break the large coal particle so that smaller particles may be easily passed through apertures 44, 46. Apertures 44,46 can themselves be of any predetermined shape and configuration as desired or necessary.

The exterior spirals 30 can be provided with suitable rigid auxiliary bits 64 periodically disposed and extending from the exterior spiral 30. Thus, such auxiliary bits 64 can be utilized to laterally cut into the mine walls 50 of the coal seam 45 so as to enhance coal mining operations.

If auxiliary bits 64 are utilized, it is preferable that a flexible intermediate spiral 70 be disposed on the exterior circumferential surface of drum 12 between adjacent convolutions of the exterior spiral 30. The intermediate spiral 70 should be flexible yet durable to withstand the rugged demands of mining equipment. For example, the intermediate spiral 70 may be constructed of durable synthetic rubber or rubber-like material. As shown in FIG. 1, the intermediate spiral 70 extends continuously around the circumferential surface of the drum 12 and is projected therefrom a distance which is preferably at least equal to the combined distance that the auxiliary bits 64 and the exterior spiral 30 project from drum 12. Thus, in such a manner, the intermediate spiral 70 will contact the mine walls 50 so as to provide a "sweeping" action thereto. It is presently contemplated that use of the intermediate spiral 70 can be utilized to more effectively enhance coal recovery operations by recovering fine particles of coal which otherwise would have escaped. While a continuous intermediate spiral arrangement has been shown and described, it is also conceivable that flexible bristle means could be utilized and periodically spaced in a spiral arrangement between adjacent convolutions of the exterior spiral 30. Such bristle means could be constructed of flexible yet durable bristles of metal or synthetic fiberous materials.

The rotatable shaft 14 can be hollow through which water under pressure may be injected (arrow 72). The cutting bit 20 will, according to this modification, have a spray nozzle that is axially located with shaft 14 so that the injected water can pass therethrough and spray in advance (arrow 73) of cutting bit 20. In such a manner, the injected water provides lubrication of the cutting bit so as to aid in the removal and cutting of coal from the seam. Other liquids, such as solvents or lubricants may be utilized, however, water is preferable.

A fan 80 may be provided coaxially mounted with the shaft which turns with the rotating drum 12. Fan 80 is provided so as to move air rearwardly relative to the drum 12 so as to entrain fine particles of coal dust, for example, in the moving air thereby preventing such coal dust from becoming part of the atmosphere in the underground mine. The fan can be located in a suitable duct (not shown) so that the entrained coal dust can be transferred via the duct to any predetermined location. Since coal dust is potentially dangerous, the use of such a fan in conjunction with the present invention is highly desirable yet is not critical to the operation thereof as has been described above. Suitable conventional driven means such as a motor 85 can be utilized to rotate the drum 12 about shaft 14.

Figure 2:
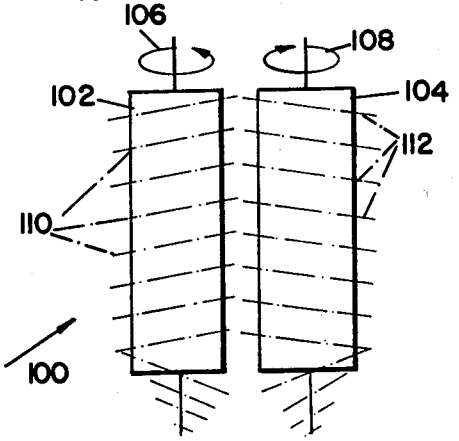
FIG. 2 is a schematic representation of a dual rotatable drilling head assembly according to the present invention.

Referring now more specifically to FIG. 2, a schematic representation of a dual drilling head assembly 100 is depicted. The assembly 100 generally comprises two rotatable drilling heads 102, 104 in accordance with the present invention. Each such drilling head 102, 104 is opposite hand relative to the other and is similarly rotatable opposite thereto (e.g. in directions noted by arrows 100, 108). Thus, the exterior spirals 110, 112 can be provided with an intermeshing relationship so as to more effectively enhance the coal mining operation. However, even though two rotatable drilling heads 102, 104 are shown in FIG. 2 it should, of course, be realized that more than two drilling heads can be provided. Hence, the number of drilling heads in the assembly depicted in FIG. 2 is dictated in large part by economic factors including the ease of operating such an assembly 100.

Figure 3:
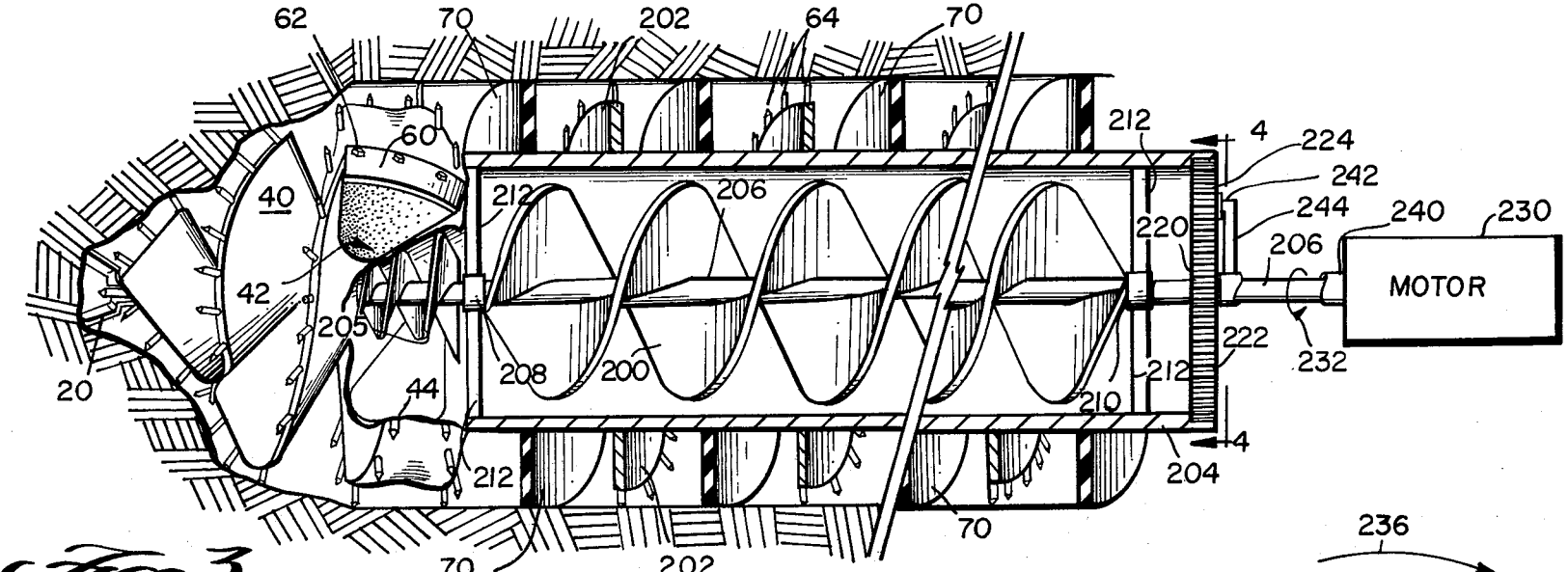
FIG. 3 is a side view partly in section of another embodiment according to the present invention wherein the interior spirals are rotatable in a direction opposite to the exterior spirals.

Referring now to FIG. 3 wherein another embodiment according to the present invention is depicted, it is seen that the interior spirals 200 are mounted so as to be rotatable in a direction opposite to the exterior spirals 202 on drum 204. Preferably, the embodiment depicted in FIG. 3 is identical to the embodiment depicted in FIGS. 1 and 2 described above with the exception that the interior spirals 200 are rigidly secured to the shaft 206 coaxially and rotatably mounted via front and rear bearings 208, 210, respectively, to drum 204. Drum 204 is rigidly secured to the exterior portion of the bearings 208, 210 by rigid support members 212 so that free rotational movement relative shaft 206 can be effected. Thus, upon rotational movement of shaft 206 in a predetermined direction, drum 204 and therefore, the exterior spirals 202 and nose spiral 40, will be rotatable in a direction opposite thereto. Also, in such a manner, the interior spirals 202 are freely rotatable independent of the exterior spirals thereof.

I find it particularly advantageous in the embodiment depicted in FIG. 3 to extend the interior spiral 202 beyond the forward end of drum 204 so as to provide a section 205 of interior spirals 200 which are housed in nose spiral 40 and which assists in the movement of coal from apertures 42,44 to the interior of drum 204. Thus, section 205 should be in close proximity to apertures 42,44 so as to prevent blockage of coal accumulating thereat.

Figure 4:
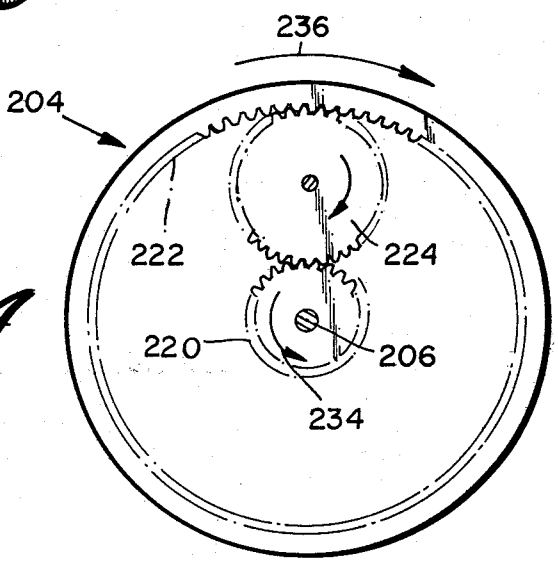
FIG. 4 is a detailed end view of the drum taken along line 4—4 in FIG. 3.

In order to effect opposite rotational movement, shaft 206 is provided at the rear end of drum 204 with a suitable drive gear 220 fixed thereto while a portion of the interior circumferential surface of drum 204 is provided with gear ring 222 (see FIG. 4). Since shaft 206 is mounted for journaled movement via bearing housings 208, 210, a pinion gear 224 can be meshed between the drive gear 220 and the gear ring 222 of the drum. Thus, upon turning movement in a predetermined direction (arrow 232) applied to shaft 206 by virtue of motor 230, drive gear 220 and, therefore, shaft 206 will rotate in the same direction (arrow 234) while gear ring 222 and thus drum 204 will rotate in a direction (arrow 236) opposite shaft 206 and drive gear 230 by virtue of pinion gear 224. In such a manner, opposite rotational movement of the interior spiral 200 and the exterior spirals 202 of drum 204 is effected.

So as to prevent planetary movement of pinion gear 224 about shaft 206, I prefer to fix the position thereof relative drive gear 220. For this purpose, a sleeve 240 may be provided such that free rotational movement of shaft 206 therein can be effected. Sleeve 240 is fixed, for example, to motor 230 at one end but is unrestrained at the other end thereof. Pinion gear 224 may then be mounted for rotational movement on a shaft 242 forming a portion of arm 244 fixed to sleeve 240.

Other suitable means may be utilized in place of the drive and pinion gear arrangement described above. For example, a capstan gear arrangement which in and of itself is well known in the mechanical arts can be provided to establish counter-rotation of drum 204 relative interior spirals 200. Of course, when consideration is given to the fact that mined particles, e.g., coal are to be encouraged out of the rear portion of drum 204, those in the art may wish to choose sufficiently small diameters of pinion gears and arrange such pinion gears relative to the drive gear to permit such an occurrence and to prevent binding of the gears. Other arrangements to effect counter-rotational movement of the drum relative the interior spirals are believed to be well within the ordinary skill of those in the art and thus will not be discussed in further detail herein.

Additionally, so as to prevent the blockage of coal particles or the like in the interior of the drum and to prevent binding of the gear arrangement described above, a separate coal "chute" or opening may be provided on the rear portion of the drum so that the coal can fall therethrough and be conveyed to other suitable locations via conventional means, such as, conveyors or the like.

Thus, according to the embodiment of the present invention as depicted in FIGS. 3 and 4, not only will the opposite hand arrangement of the interior spirals be effective in conveying coal to the rear thereof, but also the independent rotational movement of the interior spirals will effectively prevent the clogging of the interior portion of the drum.

While reference has been herein made to coal and/or coal particles, such a reference thereto is intended to be nonlimiting to the present invention and represents merely a preferred embodiment of the present invention. Accordingly, it is highly conceivable that the present invention can be utilized satisfactorily in tunneling operations wherein the mined particles do not have any intrinsic value. Also, the present invention may be utilized in soft soil, dirt, gravel or the like without the need for the cutting bits as herein described.

Accordingly, while the present invention has been herein described in what is presently conceived to be the most preferred embodiments thereof, it will be understood by those in the art that many modifications may be made herein within the scope of the present invention, which scope shall be accorded the broadest interpretation of the appended claims so as to encompass all equivalent structures, devices, or assemblies.

I claim:

1. A drilling head for use in mining operations adapted for being rotatable about its elongated axis in a predetermined rotational direction and advanceable so as to cut and remove material particles from a seam of material, said drilling head comprising in combination:

a cylindrical drum having a front end and an open rear end and defining between said front and rear ends an interior cavity;

first spiral means rigidly fixed to the exterior surface of said drum and outwardly projecting therefrom spirally disposed between said front and rear ends, the convolutions of said first spiral means being arranged for forwardly advancing said material particles as said drum rotates in said predetermined direction;

nose spiral means axially disposed in advance of said front end, the radial dimension of successive convolutions of said nose spiral means decreasing away from said front end and arranged for encouraging rearward advancement of said material particles as said drum rotates in said predetermined direction, said nose spiral means at said front end terminating with the forward portion of said first spiral means and defining therewith at least one recovery aperture in communication with said interior cavity so that material particles forwardly advancing by virtue of said first spiral means and rearwardly advancing by virtue of said nose spiral means will pass through said at least one recovery aperture to said interior cavity;

adjustable plate means covering a portion of said at least one recovery aperture for restricting the size of material particles which pass therethrough;

second spiral means coaxially disposed in said drum between said front and rear ends in said interior cavity, the convolutions of said second spiral means being arranged for encouraging said material particles which pass through said at least one recovery aperture to rearwardly advance in said interior cavity when said second spiral means rotates in a direction opposite to said predetermined direction; and mounting means for mounting said drum and said second spiral means for independent rotational movement relative to one another.

2. A drilling head as in claim 1 further comprising means for rotating said second spiral means and said drum in opposing directions relative to one another.

3. A drilling head as in claim 1 or 2 further comprising material cutting means in advance of said nose spiral means for cutting said material particles from said material seam.

4. A drilling head as in claim 1 further comprising flexible third spiral means disposed intermediate adjacent convolutions of said first spiral means for contacting the peripheral wall of the mined cavity.

5. A drilling head as in claim 1 or 4 further comprising auxiliary bit means projecting from said first spiral means for laterally cutting material particles from said material seam.

6. In combination with a mining machine, a drilling head as in claim 1, said mining machine including means for rotating said drum and said second spiral means in opposing directions relative to one another.

7. A drilling head assembly comprising a plurality of drilling heads as in claim 1 each being rotatable in a direction opposite to each adjacent drilling head thereof.

8. In combination with a mining machine, a drilling head assembly as in claim 7, said mining machine including for each of said drilling heads means for rotating said drum and said second spiral means in opposing directions relative to one another.

* * * * *